US012366418B2

(12) United States Patent
Ariyama et al.

(10) Patent No.: US 12,366,418 B2
(45) Date of Patent: Jul. 22, 2025

(54) HEAT EXCHANGER

(71) Applicants: MAHLE International GmbH, Stuttgart (DE); MAHLE Japan Ltd., Tokyo (JP)

(72) Inventors: Masahiro Ariyama, Tokyo (JP); Ryoichi Kurihara, Tokyo (JP); Takuma Shibata, Tokyo (JP); Satoshi Suzuki, Tokyo (JP); Kenji Wada, Tokyo (JP); Kenji Yamashita, Tokyo (JP)

(73) Assignees: Mahle International GmbH (DE); MAHLE Japan Ltd (JP)

( * ) Notice: Subject to any disclaimer, the term of this patent is extended or adjusted under 35 U.S.C. 154(b) by 195 days.

(21) Appl. No.: 18/124,981

(22) Filed: Mar. 22, 2023

(65) Prior Publication Data

US 2023/0304744 A1 Sep. 28, 2023

(30) Foreign Application Priority Data

Mar. 22, 2022 (JP) ..... 2022-045877

(51) Int. Cl.
*F28D 9/00* (2006.01)
*F28F 3/08* (2006.01)

(52) U.S. Cl.
CPC ..... *F28D 9/0075* (2013.01); *F28F 3/086* (2013.01)

(58) Field of Classification Search
CPC ..... F28D 9/005; F28D 9/0075; F28D 9/0043; F28F 2250/004; F28F 3/086
See application file for complete search history.

(56) References Cited

U.S. PATENT DOCUMENTS

| | | | | |
|---|---|---|---|---|
| 6,164,371 | A * | 12/2000 | Bertilsson | F28D 9/0093 165/140 |
| 11,965,700 | B2 * | 4/2024 | Schumacher | F28F 9/0221 |
| 2017/0176065 | A1 * | 6/2017 | Kuroda | F28F 3/08 |
| 2017/0184347 | A1 * | 6/2017 | Ariyama | F28D 9/005 |
| 2018/0094870 | A1 * | 4/2018 | Ariyama | F28D 9/0075 |
| 2019/0063846 | A1 * | 2/2019 | Bluetling | F28D 9/0093 |
| 2021/0254907 | A1 * | 8/2021 | Nita | F28F 13/12 |

FOREIGN PATENT DOCUMENTS

| | | | | |
|---|---|---|---|---|
| JP | 2003194489 | A * | 7/2003 | F28D 9/005 |

* cited by examiner

*Primary Examiner* — Jianying C Atkisson
*Assistant Examiner* — For K Ling
(74) *Attorney, Agent, or Firm* — Fishman Stewart PLLC

(57) ABSTRACT

A heat exchanger is disclosed. The heat exchanger includes a heat exchanger core including a stacked plurality of plates, a top plate, and a bottom plate. The plurality of plates includes two end portion plates, and a plurality of intermediate plates stacked between the end portion plates. Each of the plurality of intermediate plates has a flow-through portion penetrating through the intermediate plates through which a fluid flows. Each of the through holes of each of the plurality of intermediate plates demarcates a flowthrough path which penetrates through the intermediate plate in the stacking direction and is isolated from the flow path between plates. A boss portion having a substantially elliptical shape edge portion is formed at each plate.

18 Claims, 12 Drawing Sheets

HEAT EXCHANGER

CROSS-REFERENCE TO RELATED APPLICATION

This application claims priority to Japan Application No. JP 2022-045877 filed on Mar. 22, 2022, the contents of which are hereby incorporated by reference in its entirety.

TECHNICAL FIELD

The present invention relates to a heat exchanger.

BACKGROUND

A heat exchanger where heat is exchanged between a plurality of fluids is utilized as a water-cooled type oil cooler in which a lubricating oil of an internal combustion engine is cooled by means of a refrigerant such as, for example, a long-life coolant (LLC). A heat exchanger which has improved heat exchange efficiency by means of a communicating pathway, while achieving weight saving by reducing the wall thickness of a distance plate stacked in a core, is known (refer, for example, to Patent Literature 1).

[Patent Literature 1] JP Patent Appl. Publ. No. 2017-120131

SUMMARY

There is a heat exchanger where, by U-turning the fluid circuit inside the heat exchanger where a heat exchange of fluid occurs, the flow path length is ensured and the heat exchange amount of the heat exchange portion is improved. In such a case, a flow path for circulating a fluid (hereinunder also referred to as 'flow path for circulation') is generally provided in order for the inlet and outlet of a fluid to be at the same surface side of the heat exchanger.

However, because the aforementioned flow path for circulation was provided separately to the portion where heat exchange takes place in the heat exchanger of Patent Literature 1, device constituents could not be miniaturized.

Thus, in consideration of the above-mentioned problem, the objective of the present invention is to miniaturize a heat exchanger.

In order to solve the aforementioned problem, the heat exchanger according to the present invention comprises a heat exchange core consisting of a stacked plurality of plates, a top plate and a bottom plate, where: a plurality of the plates comprises two end portion plates, and a plurality of intermediate plates stacked between the two end portion plates; of the plurality of the plates, each set of adjacent said plates demarcates a flow path between plates such that fluid flows therebetween; each plurality of the plates has a flow-through portion penetrating through the plates through which a fluid flows, and at least one set of the flow-through portion is provided at one of the flow paths between plates, so as to enable the fluid to flow from one side to an other side; each plurality of the plates further comprises a through hole, and each of the through holes demarcates a portion of a flowthrough path which penetrates through a plurality of the plates in a stacking direction and is isolated from the flow path between plates; a boss portion comprising a substantially elliptically shaped edge portion is formed at each of the plates, at the outer side of the flow-through portion and the through hole, as seen in a plan view of the heat exchange core; of the end portion plates, a circulating flow portion is formed from the flow-through portion, the through hole and an internal space of the boss portion, in at least either one of the end portion plate on an upper side of the stacking direction and the end portion plate on a lower side of the stacking direction.

In this mode, because the circulating flow portion is formed by the boss portion formed in a plate, there is no need to newly add a member for forming a flow path for circulation, and hence a heat exchanger can be miniaturized. Moreover, because the boss portion shapes of each plate are also closely similar, press forming of different kinds of plates can also be reasonably performed using closely similar dies in press processing work.

Specifically, an intermediate plate is configured of a first core plate of which the boss portion protrudes at the upper side of the stacking direction and a second core plate of which the boss portion protrudes at the lower side of the stacking direction. The end portion plate on an upper side consists of an upper side second core plate, and the upper side second core plate is configured such that the boss portion is formed by protruding to the lower side and the top plate is brazed to an upper face. The circulating flow portion can be configured so as to be formed in between the flow-through portion, the through hole, the boss portion, and the top plate.

Moreover, the end portion plate on the lower side consists of a lower side first core plate, and the lower side first core plate is configured such that the through hole is not formed at the flow-through portion, the boss portion is formed by protruding to the upper side, and the bottom plate is brazed to a lower face. In the bottom plate, a hole is formed at the position of the flow-through portion as seen in a plan view of the heat exchange core, where the hole forms a portion of the flow-through portion. The circulating flow portion can also be configured so as to be formed in between a hole of the bottom plate, the through hole, the boss portion and the bottom plate.

A heat exchanger can be miniaturized by the present invention.

DETAILED DESCRIPTION

An embodiment of the present invention will be explained as follows, with reference to the drawings. In the below embodiment, an example will be explained in which the heat exchanger according to the present invention is utilized as a water-cooled type oil cooler in which a lubricating oil of an internal combustion engine is cooled by means of a refrigerant such as a long-life coolant (LLC).

Figure 1:
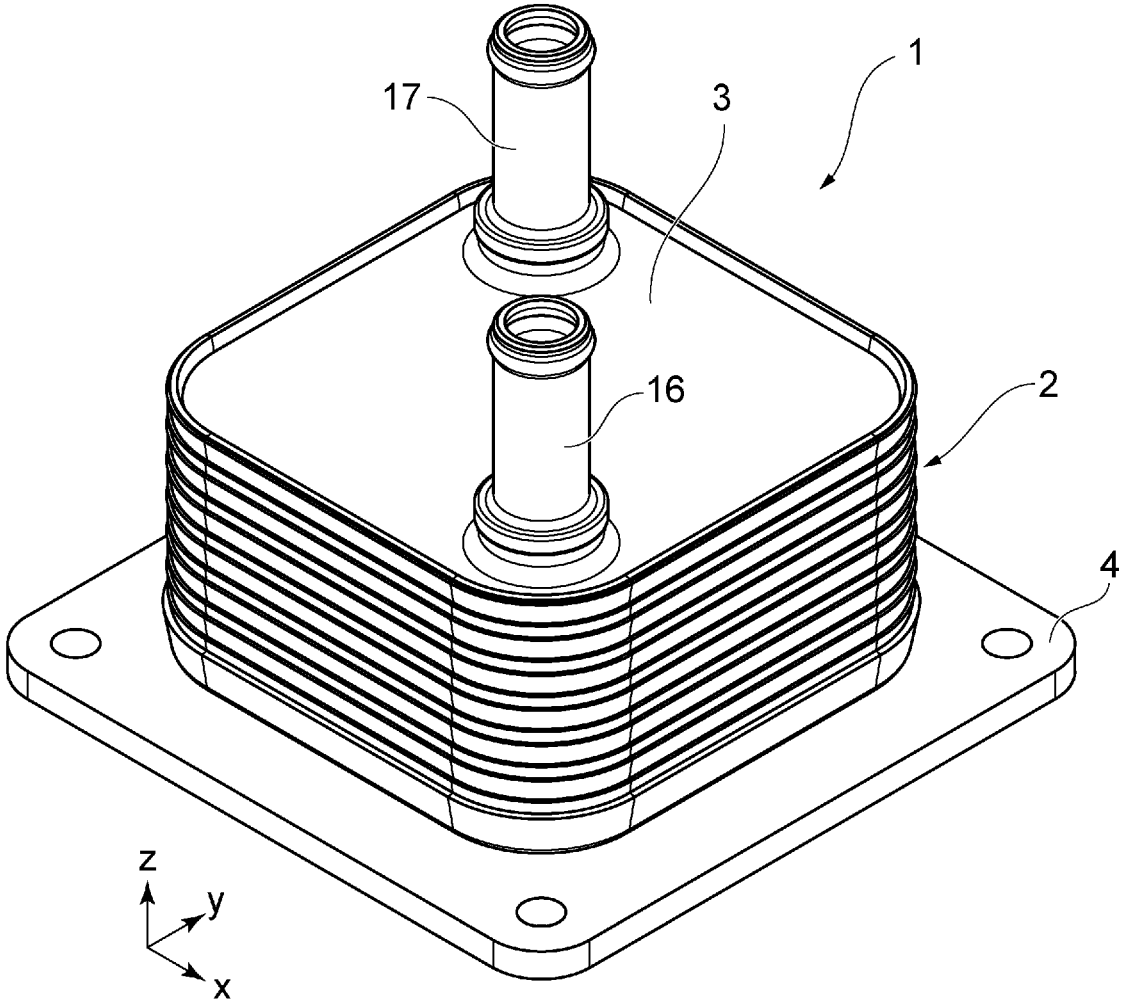
FIG. 1 is a perspective view of an oil cooler according to an embodiment.
Figure 2:
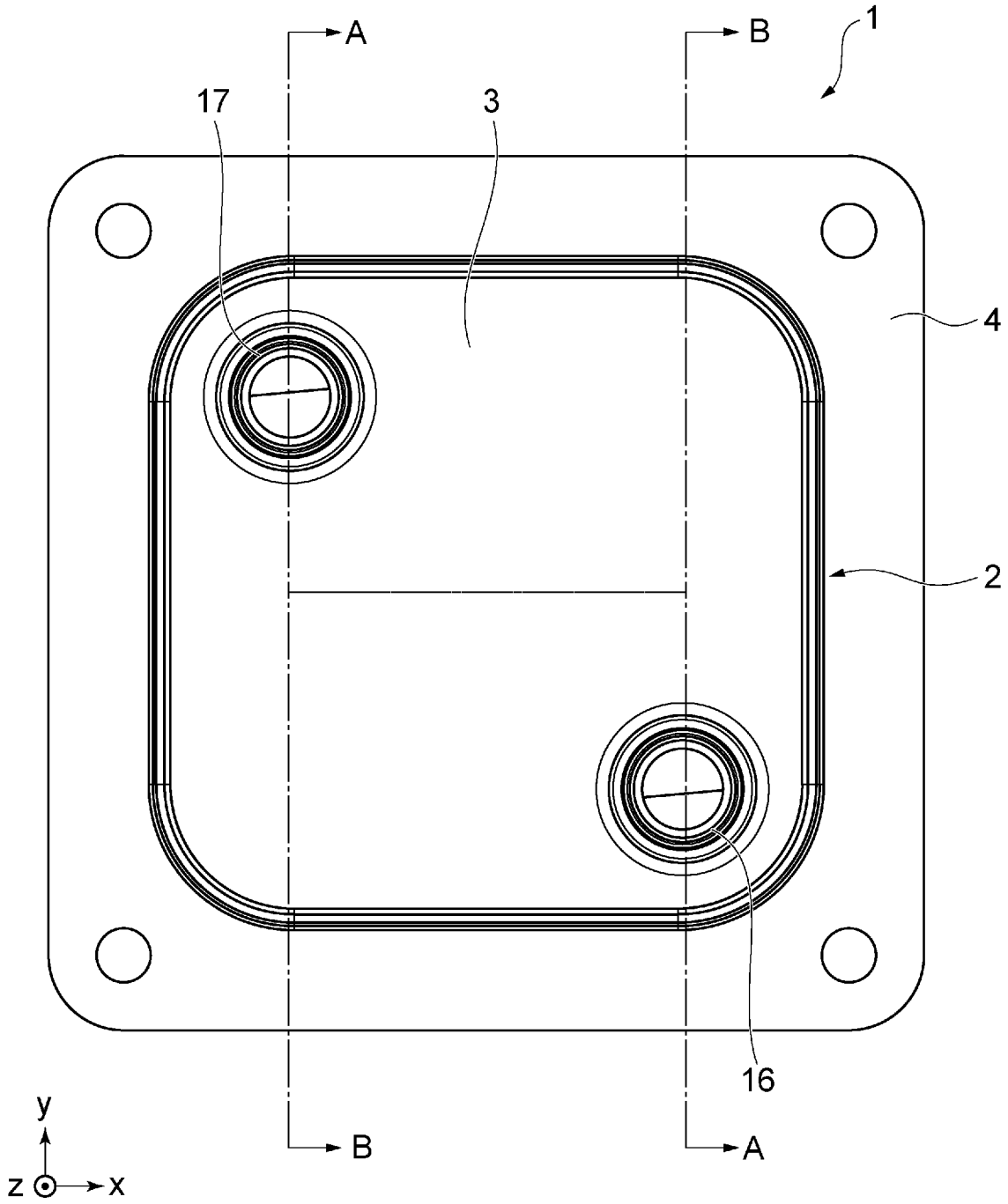
FIG. 2 is a plan view of an oil cooler according to an embodiment.
Figure 3:
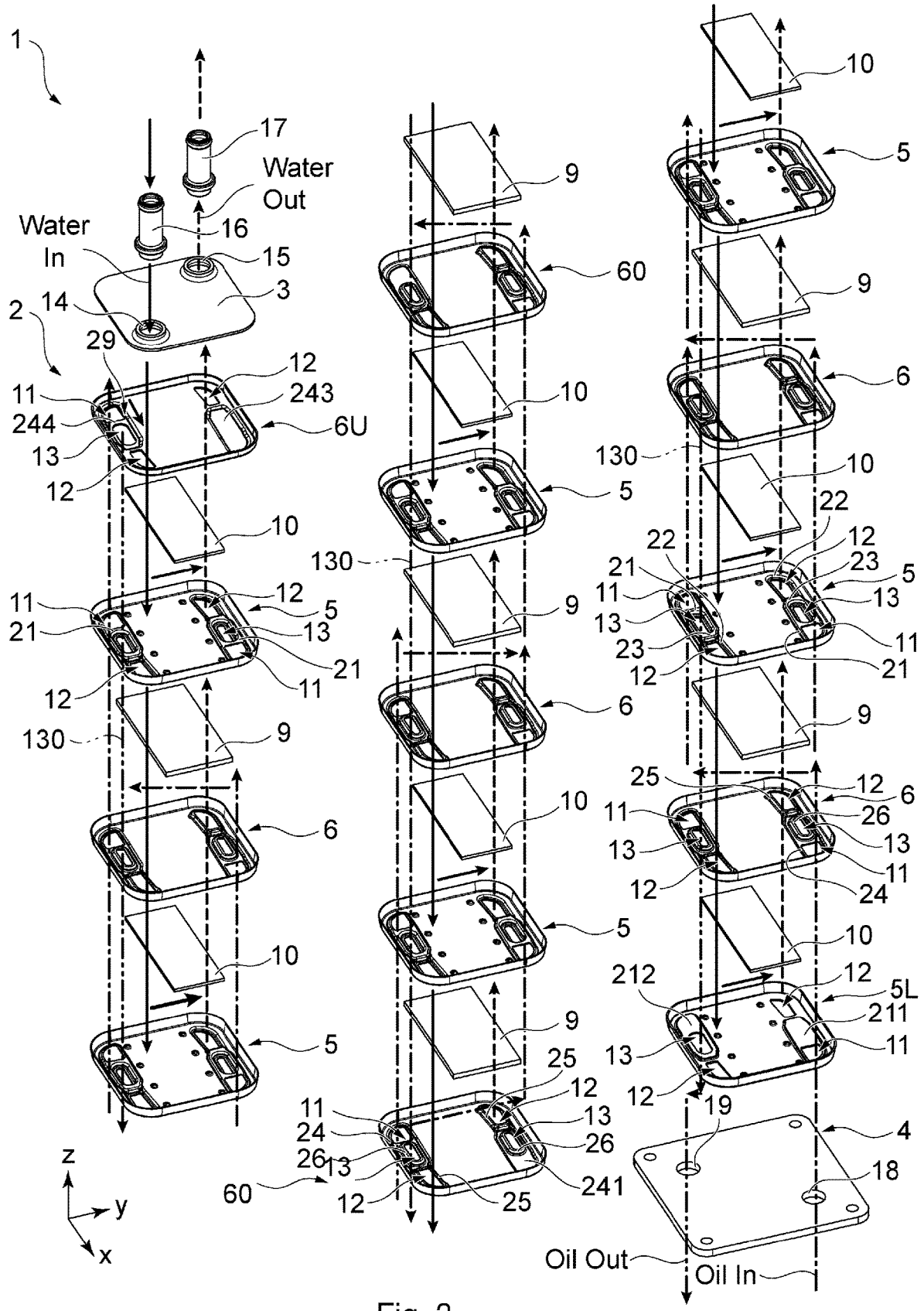
FIG. 3 is an exploded perspective view of an oil cooler according to an embodiment.

FIG. 1 is a perspective view of oil cooler 1. Moreover, FIG. 2 is a plan view of oil cooler 1. Moreover, FIG. 3 is an exploded perspective view of oil cooler 1. An oil cooler 1, which is an embodiment of the heat exchanger of the present invention, is explained.

As illustrated in FIGS. 1 to 3, the oil cooler 1 comprises a stacked plurality of plates. The plurality of plates comprise two end portion plates (upper side second core plate 6U, lower side first core plate 5L), and a plurality of intermediate plates (first core plates 5, second core plates 6, 60) stacked between the two end portion plates. Each adjacent set of intermediate plates of the plurality of intermediate plate demarcates flow paths between plates (oil flow path between plates 7 and coolant flow path between plates 8) such that fluid flows therebetween. Each plurality of intermediate plates has flow-through portions (oil passage hole 11, coolant passage hole 12) penetrating through the intermediate plate through which a fluid flows. At least one set of the flow-through portions is provided at one of the flow paths between plates so as to enable the fluid to flow from one side of the flow-through portion to the other side of the flow-through portion. Each of the plurality of intermediate plates further comprises a through hole 13, where each of the through holes 13 demarcates a portion of a flowthrough path 130 which penetrates through the plurality of intermediate plates in the stacking direction and is isolated from the flow path between plates. Each of the plurality of intermediate plates comprises a first boss portion (boss portions 23, 26) formed so as to protrude from each of the adjacent intermediate plates until they abut each other. Each of the plurality of intermediate plates comprises a second boss portion (boss portions 21, 24, 241) formed so as to protrude from each of the adjacent intermediate plates until they abut each other, where the second boss portion is formed so as to surround the first boss portion and protrude in the reverse direction to the first boss portion. The oil cooler 1 according to the present embodiment will be specifically explained as follows.

For convenience of explanation below, of the directions following along the surfaces of the first core plate 5, second core plates 6, 60, upper side second core plate 6U and lower side first core plate 5L of the oil cooler 1 in FIGS. 1 to 3, one direction following along the x-axis (left-right direction) is configured as the x-direction, and the other direction following along the y-axis (front-back direction) is configured as the y-direction. Moreover, the direction following along the z-axis direction, which is orthogonal to the x-axis and y-axis in oil cooler 1 (z-direction), is configured as the up-down direction or the stacking direction of the first core plate 5, second core plates 6, 60, upper side second core plate 6U, and lower side first core plate 5L. One side of the stacking direction is the z-axis direction upper side, and the other side of stacking direction is the z-axis direction lower side. The below explanation of the positional relationship and direction of each constituent element as a right side, left side, front side, back side, upper side, lower side, top portion, bottom portion etc. merely illustrates the positional relationship and direction in the drawings, and there is no limitation on positional relationships and directions in an actual heat exchanger.

Figure 4:
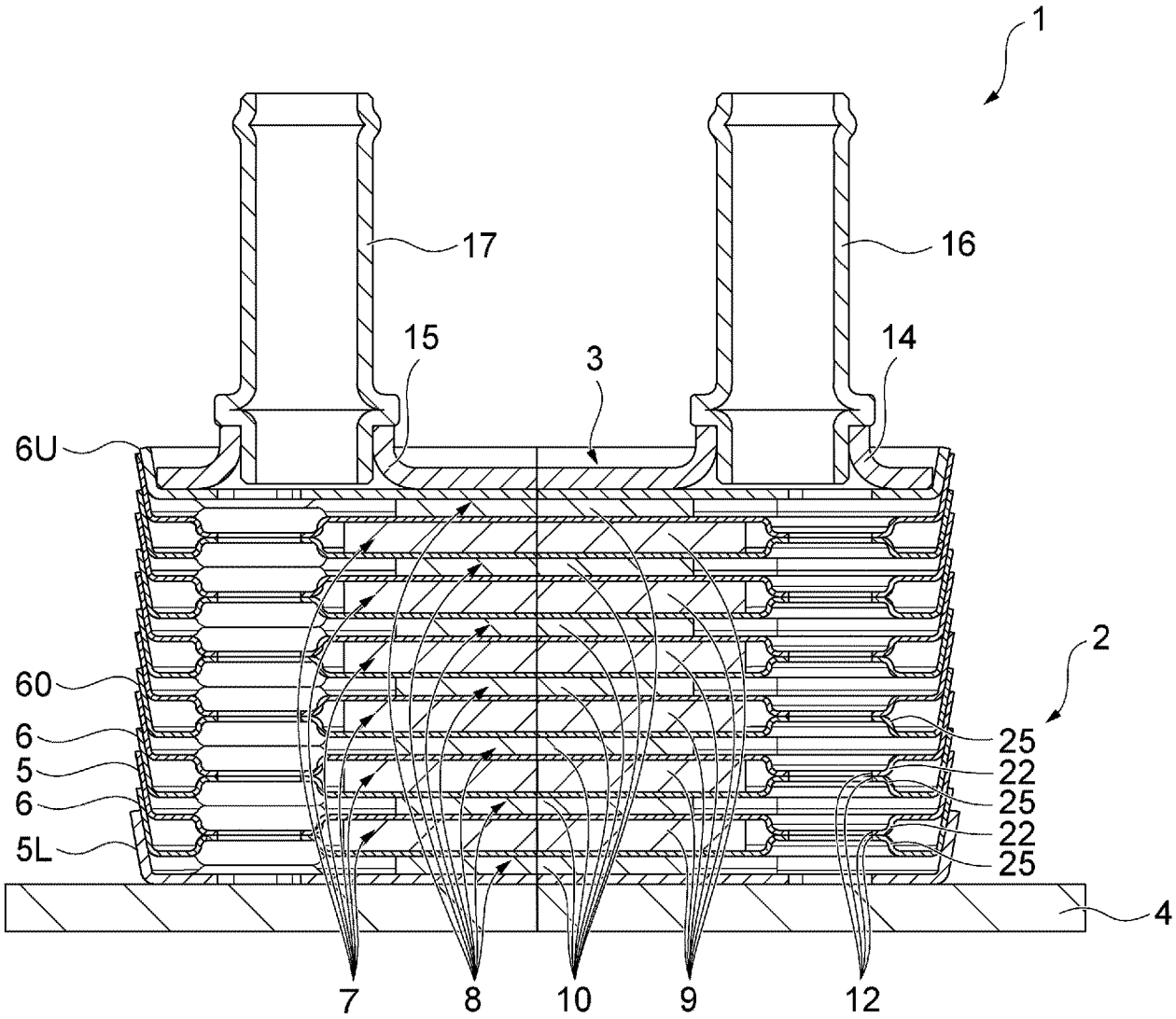
FIG. 4 is a cross sectional view of FIG. 2, taken along A-A.
Figure 5:
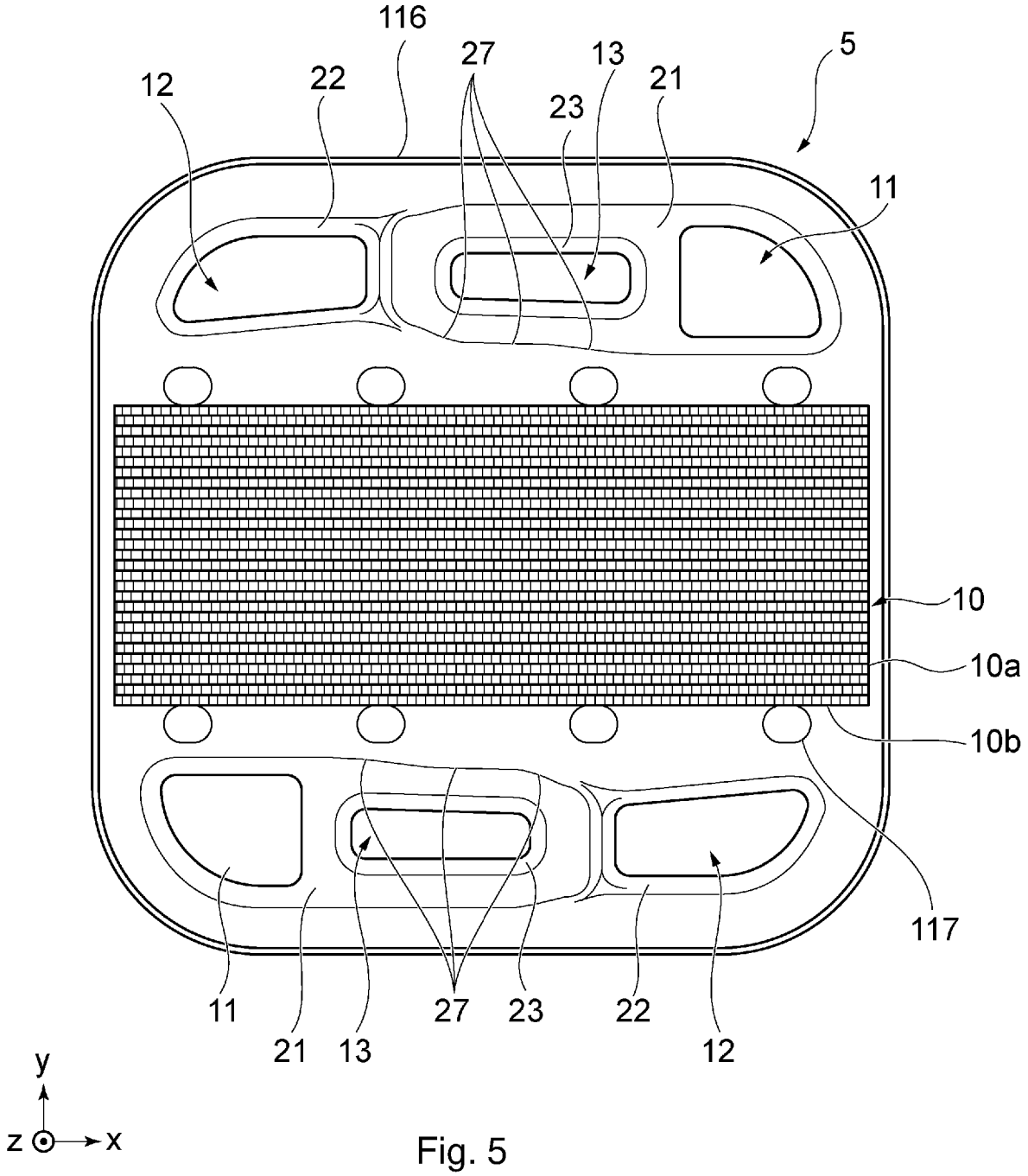
FIG. 5 is a plan view of a first core plate of an oil cooler according to an embodiment.
Figure 6:
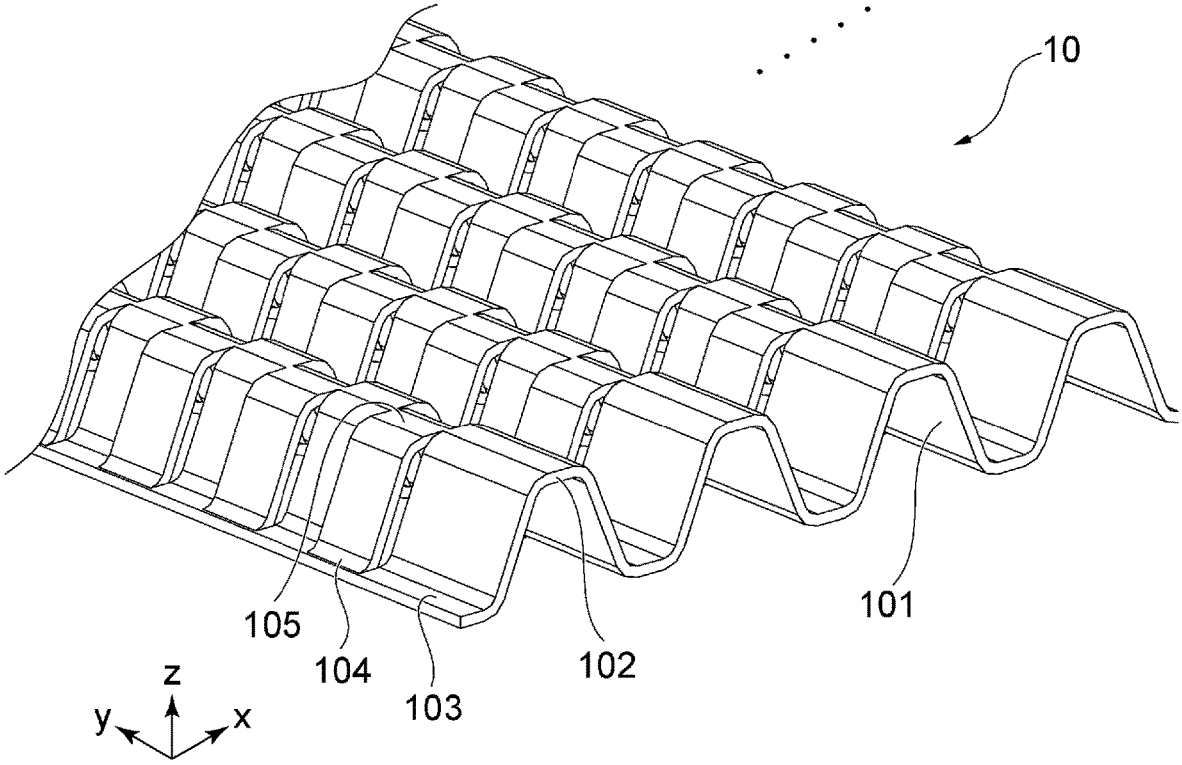
FIG. 6 is an enlarged perspective view of a second fin plate of an oil cooler according to an embodiment.
Figure 7:
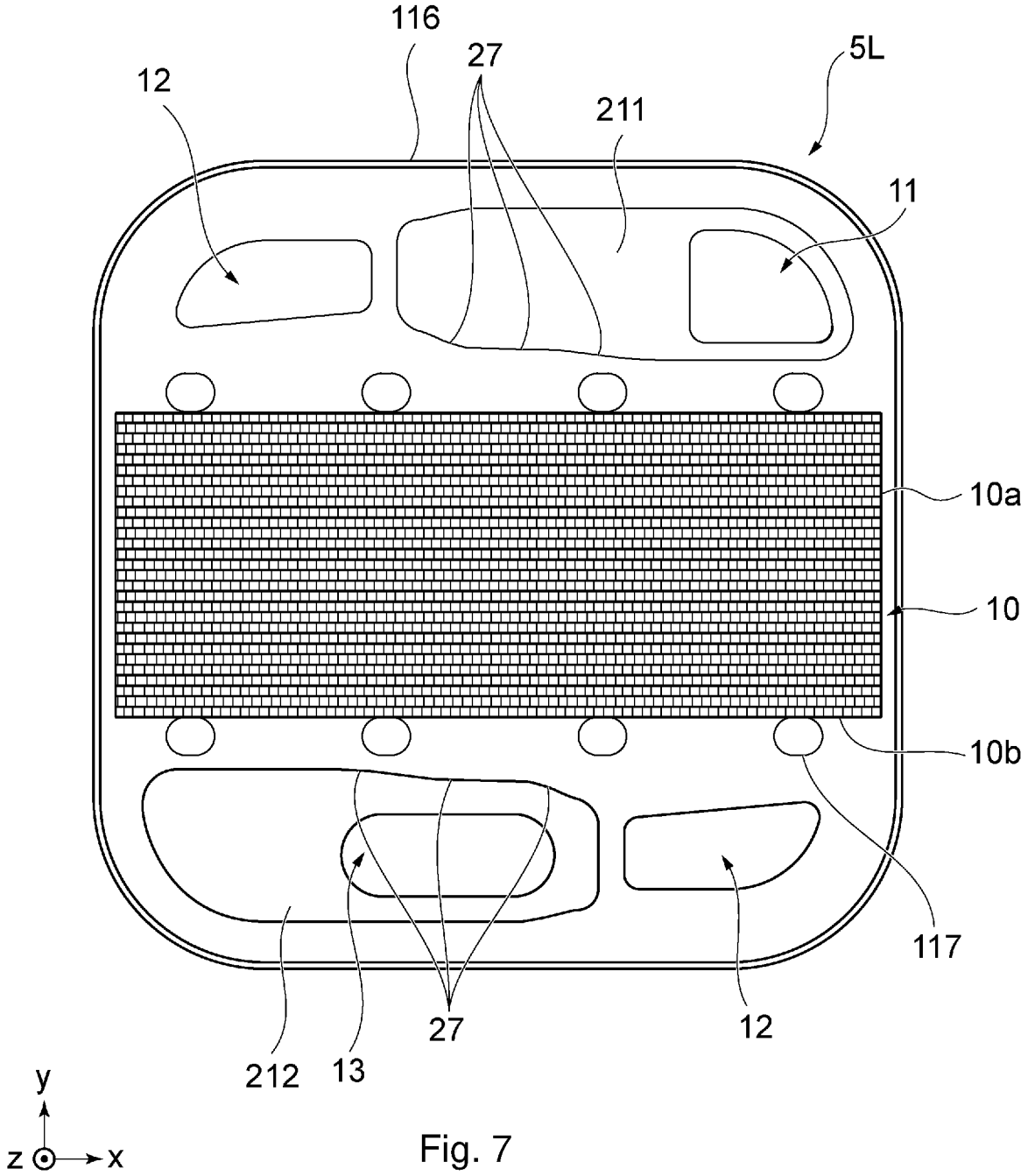
FIG. 7 is a plan view of a lower side first core plate of an oil cooler according to an embodiment.
Figure 8:
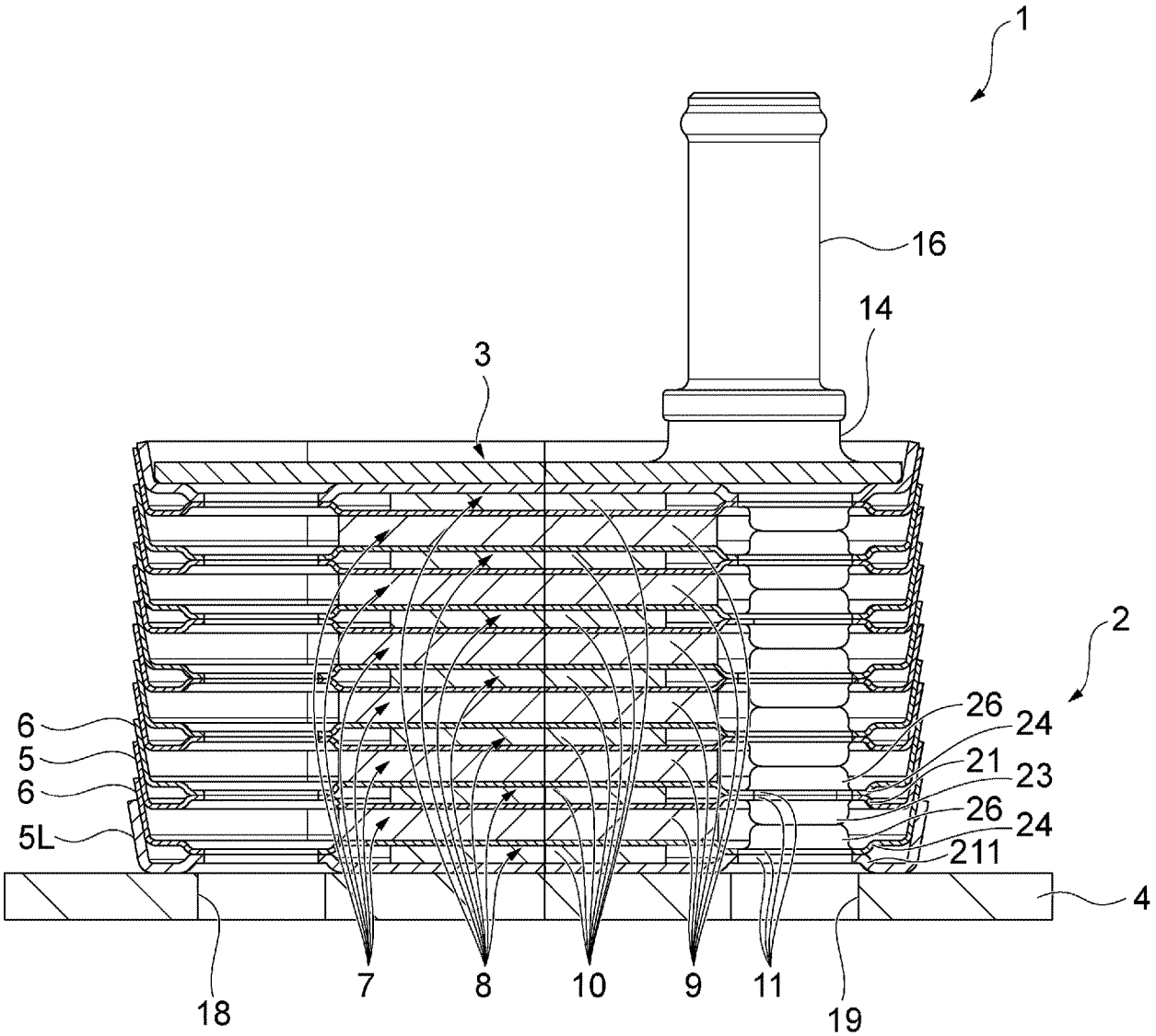
FIG. 8 is a cross sectional view of FIG. 2, taken along B-B.
Figure 9:
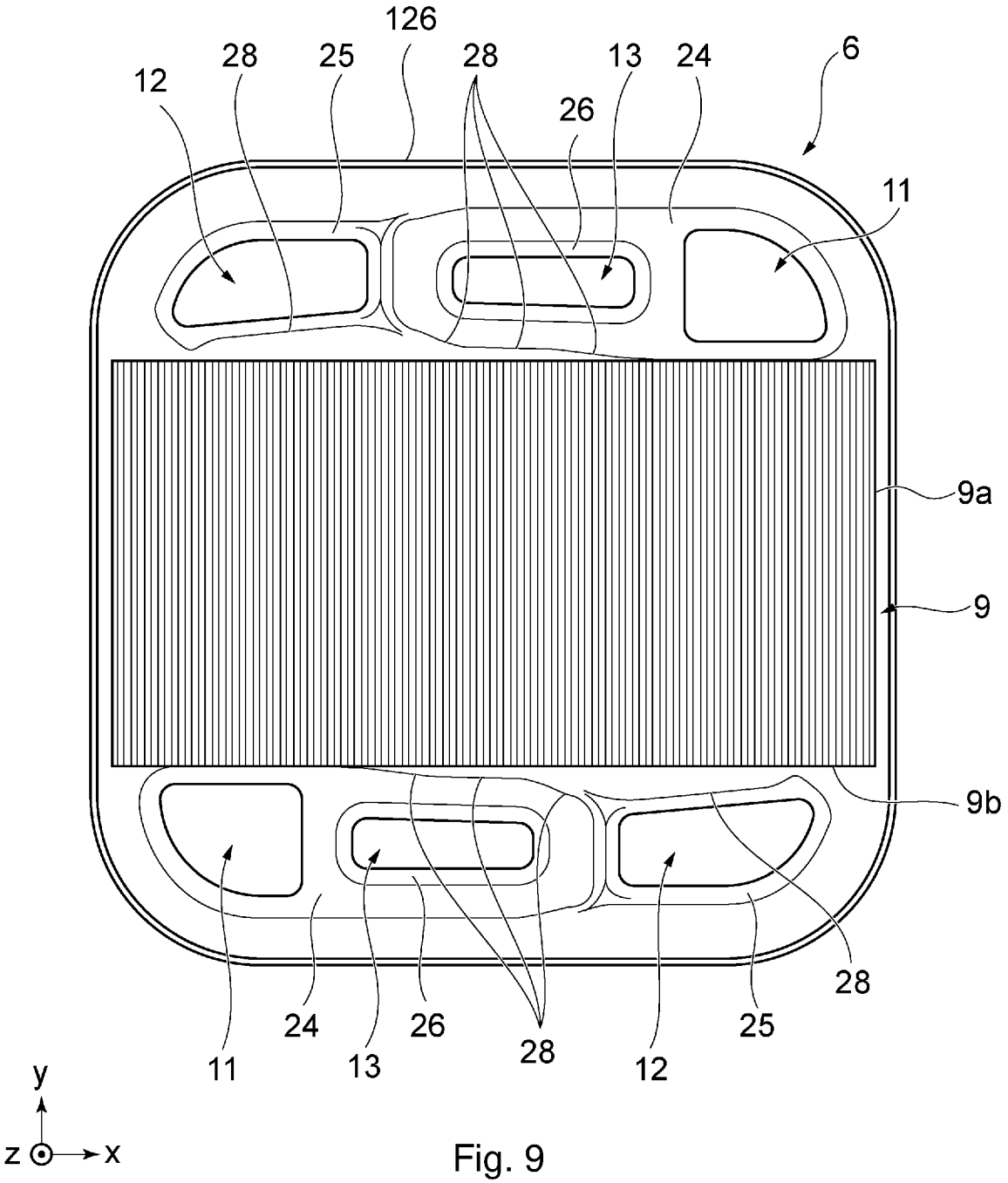
FIG. 9 is a plan view of a second core plate of an oil cooler according to an embodiment.
Figure 10:
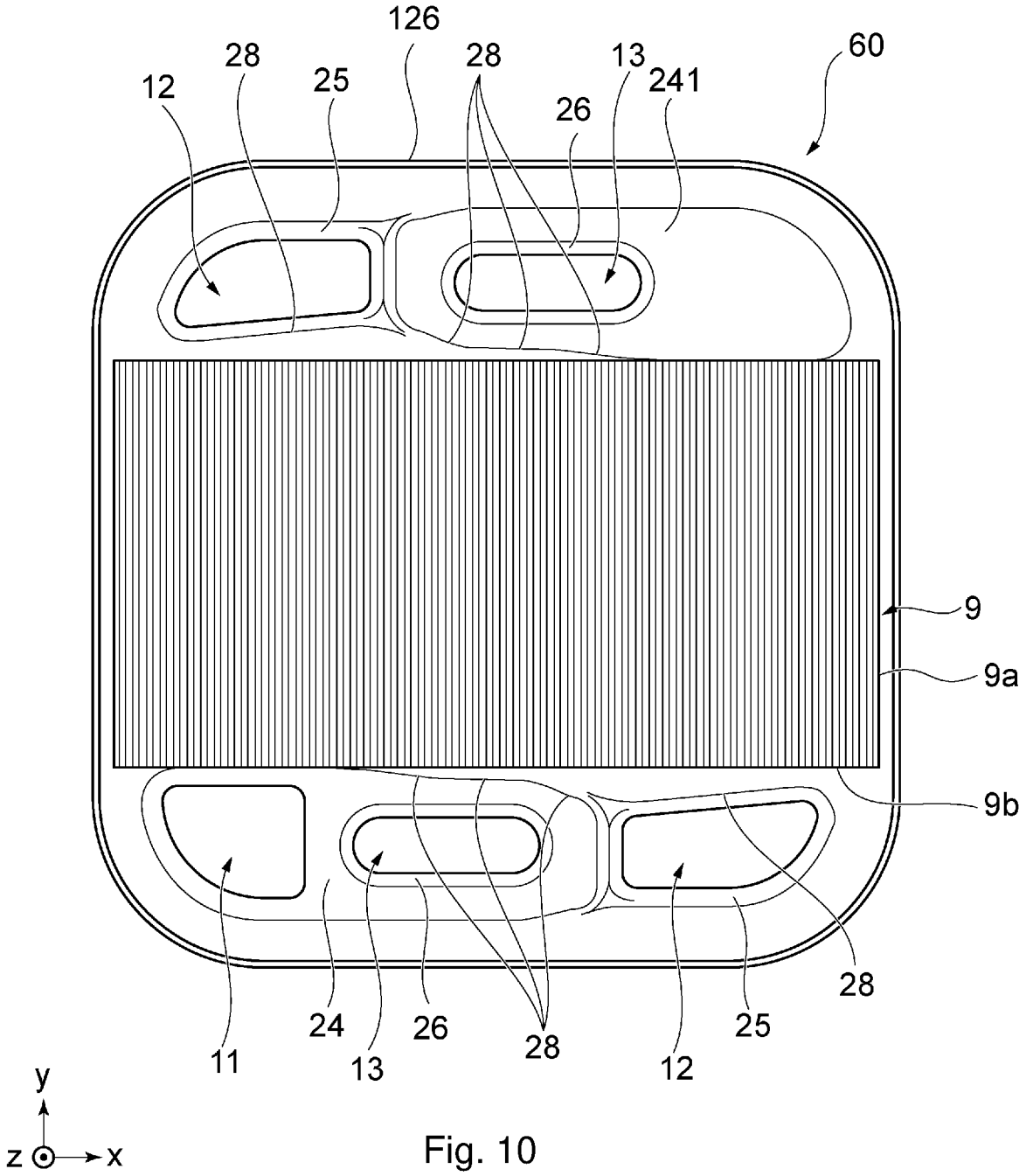
FIG. 10 is a plan view of a second core plate of an oil cooler according to an embodiment.
Figure 11:
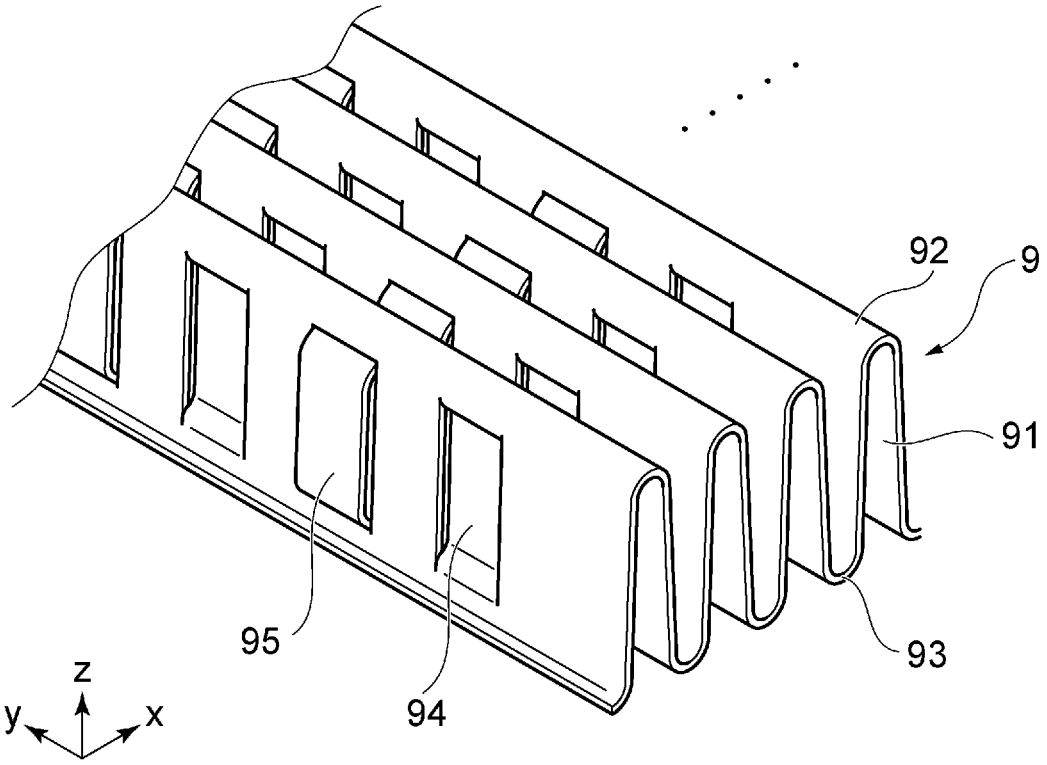
FIG. 11 is an enlarged perspective view of a first fin plate of an oil cooler according to an embodiment.
Figure 12:
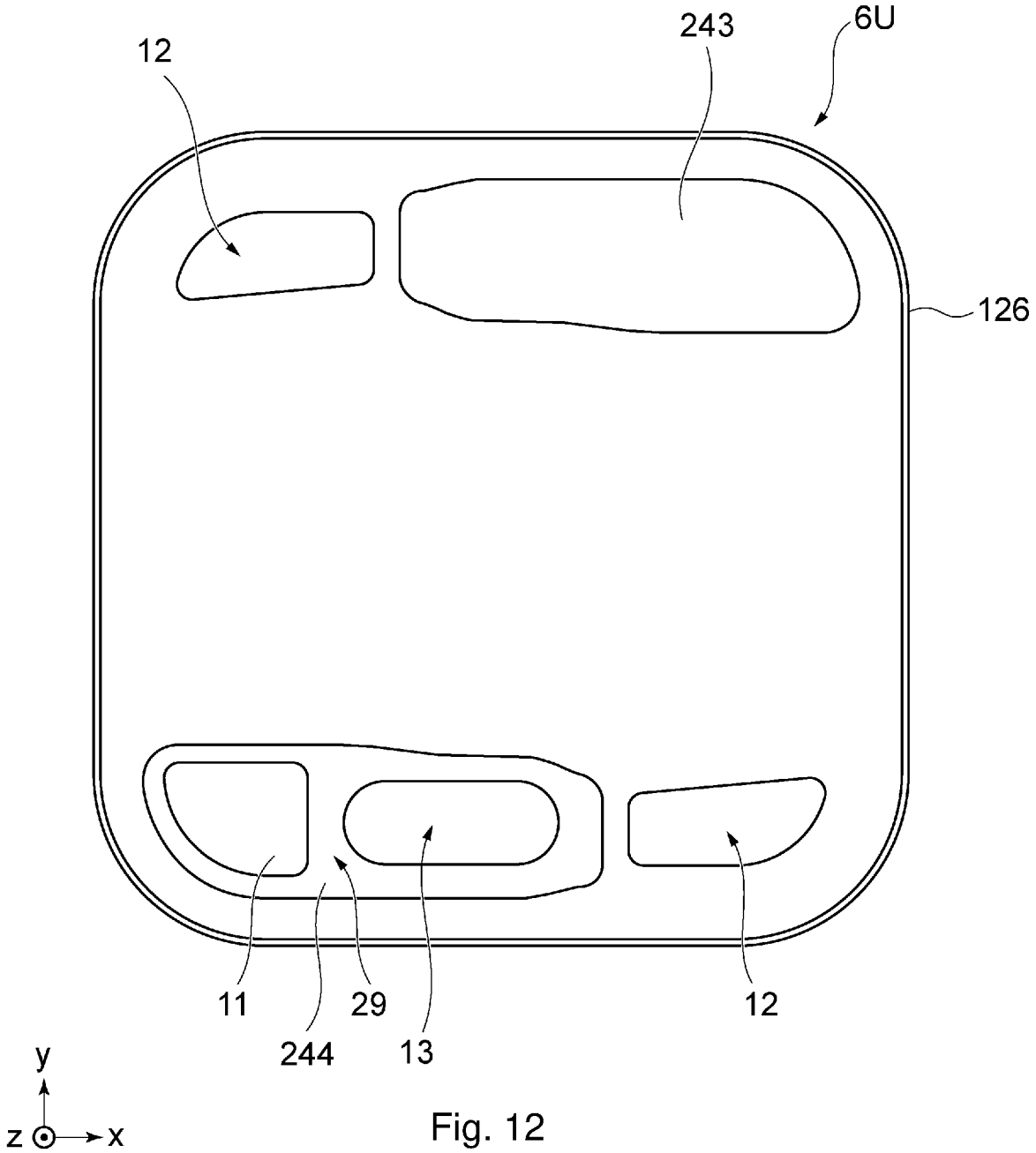
FIG. 12 is a plan view of an upper side first core plate of an oil cooler according to an embodiment.

FIG. 4 is a cross sectional view of oil cooler 1 taken along A-A. FIG. 5 is a plan view illustrating a state in which the second fin plate 10 is mounted to the first core plate 5 of oil cooler 1. FIG. 6 is an enlarged perspective view of the second fin plate 10 of oil cooler 1. FIG. 7 is a plan view illustrating a state in which the second fin plate 10 is mounted to the lower side first core plate 5L of oil cooler 1. FIG. 8 is a cross sectional view of oil cooler 1 taken along B-B. FIG. 9 is a plan view illustrating a state in which a first fin plate 9 is mounted to the second core plate 6 of oil cooler 1. FIG. 10 is a plan view illustrating a state in which the first fin plate 9 is mounted to the second core plate 60 of oil cooler 1. FIG. 11 is an enlarged perspective view of the first fin plate 9 of oil cooler 1. FIG. 12 is a plan view of the upper side second core plate 6U of oil cooler 1. The gist of oil cooler 1 will be explained by way of FIGS. 1 to 12.

As illustrated in FIGS. 1 to 3, oil cooler 1 is roughly configured from the heat exchange portion 2 (heat exchange core) where heat is exchanged between oil configured as a first fluid and coolant configured as a second fluid, a top plate 3 affixed to the upper face of the heat exchange portion 2, and a bottom plate 4 affixed to the lower face of the heat exchange portion 2.

In the heat exchange portion 2, first core plates 5 configured as a plurality of plates and second core plates 6, 60 configured as a plurality of plates being in closely similar basic shape are alternatingly stacked. Moreover, in the heat exchange portion 2, an oil flow path between plates 7 configured as a first flow path between plates (refer to FIG. 4 and FIG. 8) and a coolant flow path between plates 8 configured as a second flow path between plates (refer to FIG. 4 and FIG. 8) are alternatingly configured in between the first core plate 5 and second core plates 6, 60. In oil cooler 1, a plurality of oil flow paths between plates 7 and coolant flow paths between plates 8 are formed inside the heat exchange portion 2. For example, six oil flow paths between plates 7 and seven coolant flow paths between plates 8 are formed in the oil cooler 1 in the present embodiment.

As illustrated in FIG. 4 and FIG. 8, in oil cooler 1, the oil flow path between plates 7 is configured between the lower face of first core plate 5 and upper face of second core plates 6, 60. Moreover, in oil cooler 1, the coolant flow path between plates 8 is configured between the upper face of first core plate 5 and lower face of second core plates 6, 60. The first fin plate 9 is disposed at the oil flow path between plates 7. The second fin plate 10 is disposed at the coolant flow path between plates 8. In FIG. 3, FIG. 4 and FIG. 8, illustration of the detailed shapes of the first fin plate 9 and second fin plate 10 has been omitted.

A plurality of first core plates 5, second core plates 6, 60, lower side first core plates 5L, upper side second core plates 6U, top plate 3, bottom plate 4, a plurality of first fin plates 9 and a plurality of second fin plates 10 are integrally joined to each other by brazing. In more detail, the top plate 3, first core plate 5, lower side first core plate 5L, second core plates 6, 60 and upper side second core plate 6U are formed by using so-called cladded material, in which a brazing material layer is coated on the surface of an aluminum alloy base material. Each part is temporarily assembled at a predetermined position, and then heated in a furnace to thereby become integrally brazed.

As illustrated in FIG. 3 and FIG. 5, the first core plate 5 is formed by press-forming a thin base metal of aluminum alloy to become a rectangular overall shape (substantially square). The first core plate 5 comprises a pair of oil passage holes 11, 11 configured as a pair of first flow-through portions, a pair of coolant passage holes 12, 12 configured as a pair of second flow-through portions, and a pair of through holes 13, 13.

A pair of oil passage holes 11, 11 is positioned at the outer edge of the first core plate 5, and is formed in a symmetrical position across the center of the core plate. In further detail, the pair of oil passage holes 11, 11 is positioned at the outer edge of the first core plate 5, and is formed in a symmetrical position on a diagonal line of the first core plate 5, across the center of the first core plate 5.

A pair of coolant passage holes 12, 12 is positioned at the outer edge of the first core plate 5, and is formed in a symmetrical position across the center of the first core plate 5. In further detail, the pair of coolant passage holes 12, 12 is positioned at the outer edge of the first core plate 5, and is formed in a symmetrical position on a diagonal line of the first core plate 5, across the center of the first core plate 5.

The coolant passage hole 12 is formed so as not to overlap with oil passage hole 11. In further detail, coolant passage hole 12 is formed on a diagonal line of the first core plate 5 at a position different to the position where oil passage hole 11 is provided.

A pair of through holes 13, 13 are formed so as to be symmetrically positioned at the outer edge of the first core plate 5 across the center of the first core plate 5, and so as to be positioned between oil passage hole 11 and coolant passage hole 12.

As illustrated in FIG. 3, FIG. 5 and FIG. 8, in the first core plate 5, the perimeters of the oil passage hole 11 and through hole 13 are formed, as an elliptical or substantially elliptical shaped boss portion 21 as seen in a plan view, so as to protrude towards the side of the coolant flow path between plates 8 (upper side). The shape of the boss portion 21 is not limited to the aforementioned. Moreover, as illustrated in FIG. 3, FIG. 4 and FIG. 5, in the first core plate 5, the perimeter of the coolant passage hole 12 is formed, as a boss portion 22, so as to protrude towards the side of the oil flow path between plates 7 (lower side). Moreover, as illustrated in FIG. 3 and FIG. 5, at the first core plate 5, a perimeter of the through hole 13 is formed, as a boss portion 23, so as to protrude towards the side of the oil flow path between plates 7 (lower side). The boss portion 23 is the inner periphery side of the boss portion 21 and is formed at the outer periphery side of through hole 13.

The boss portion 21 is a protruded portion which is provided by protruding from the first core plate 5 in the stacking direction; namely, any one direction of the z-axis direction, for example, the +z-axis direction (the upper side direction in the z-axis direction of the heat exchange portion 2). The boss portion 21 is formed so as to protrude until abutting with the adjacent second core plate 6 (boss portions 24, 241). The boss portion 21 is formed so as to surround the boss portion 23 and protrude in the reverse direction to the boss portion 23. In the boss portion 21, the oil passage hole 11 provided at this boss portion 21 is adjacent to the through hole 13 provided at the boss portion 23. The boss portion 21 is also disposed adjacent to the boss portion 22. The boss portion 21 is formed in a concavo-convex shape in the cross-sectional direction of the first core plate 5. Moreover, in the boss portion 21, the edge portion protruding from the first core plate 5, as seen in a plan view of the first core plate 5, has one shape continuous with the edge portion of the boss portion 22.

As illustrated in FIG. 7, the basic aspect of the lower side first core plate 5L positioned at the lowermost part of the heat exchange portion 2 is closely similar to that of the first core plate 5. However, because of the relationship with the bottom plate 4, the lower side first core plate 5L has a configuration different to the first core plate 5 positioned at the intermediate portion of the heat exchange portion 2, as described below. Specifically, unlike the first core plate 5, the boss portion 22 and the boss portion 23 are not provided in the lower side first core plate 5L, and only a boss portion 211 and the boss portion 212 protruding towards the side of the coolant flow path between plates 8 (upper side), are provided. Moreover, only the oil passage hole 11 is provided at the boss portion 211, and the through hole 13 is not provided. Furthermore, only the through hole 13 is provided at the boss portion 212, and the oil passage hole 11 is not provided.

As illustrated in FIG. 3, FIG. 9 and FIG. 10, the second core plates 6, 60 are formed by press-forming a thin base metal of aluminum alloy to become a rectangular overall shape (substantially square). The second core plates 6, 60 comprise a pair of oil passage holes 11,11 configured as a pair of first flow-through portions, a pair of coolant passage holes 12, 12 configured as a pair of second flow-through portions, and a pair of through holes 13, 13.

A pair of oil passage holes 11, 11 is positioned at the outer edge of the second core plates 6, 60, and is formed in a symmetrical position across the center of the core plate. In further detail, a pair of oil passage holes 11, 11 is positioned at the outer edge of the second core plates 6, 60, and is formed in a symmetrical position on a diagonal line of the second core plates 6, 60, across the center of the second core plates 6, 60.

A pair of coolant passage holes 12, 12 is positioned at the outer edge of the second core plates 6, 60, and is formed in a symmetrical position across the center of the second core plates 6, 60. In further detail, a pair of coolant passage holes 12, 12 is positioned at the outer edge of the second core plates 6, 60, and is formed in a symmetrical position on a diagonal line of the second core plates 6, 60, across the center of the second core plate 6.

The coolant passage hole 12 is formed so as not to overlap with oil passage hole 11. In further detail, coolant passage hole 12 is formed on a diagonal line of second core plates 6, 60 at a position different to the position where oil passage hole 11 is provided.

A pair of through holes 13, 13 are formed so as to be symmetrically positioned at the outer edge of the second core plates 6, 60 across the centers of second core plates 6, 60, and so as to be positioned between oil passage hole 11 and coolant passage hole 12.

As illustrated in FIG. 3, FIG. 8, FIG. 9 and FIG. 10, at the second core plates 6, 60, the perimeters of the oil passage hole 11 and through hole 13 are formed, as an elliptical or substantially elliptical shaped boss portion 24, as seen in a plan view, so as to protrude towards the side of the coolant flow path between plates 8 (lower side). The shape of the boss portion 24 is not limited to the aforementioned shape. Moreover, as illustrated in FIG. 3, FIG. 4, FIG. 9 and FIG. 10, at the second core plates 6, 60, the perimeter of the coolant passage hole 12 is formed, as a boss portion 25, so as to protrude towards the side of the oil flow path between plates 7 (upper side). Moreover, as illustrated in FIG. 3, FIG. 8, FIG. 9 and FIG. 10, at the second core plate 6, a perimeter of the through hole 13 is formed, as a boss portion 26, so as to protrude towards the side of the oil flow path between plates 7 (upper side). The boss portion 26 is the inner periphery side of the boss portion 24, and is formed at the outer periphery side of through hole 13.

As illustrated in FIG. 10, the second core plate 60 has a configuration somewhat different to the second core plate 6.

Specifically, in the second core plate 60, one boss portion 24 and not a pair thereof (i.e., not two boss portions 24) is provided, and a boss portion 241 having a flat shape corresponding to the boss portion 24 on a diagonal line of the boss portion 21 is provided. The boss portion 241 is formed so as to protrude towards the side of the coolant flow path between plates 8 (lower side). The oil passage hole 11 is not provided in the boss portion 241, and only the through hole 13 is provided. The boss portion 26 is provided at the perimeter of the through hole 13 provided at the boss portion 241.

The boss portions 24, 241 are protruded portions which are provided by protruding in the stacking direction from the second core plates 6, 60; namely, any one direction of the z-axis direction, for example, the −z-axis direction (the lower side direction in the z-axis direction of the heat exchange portion 2). The boss portions 24, 241 are formed so as to protrude until abutting with the adjacent first core plate 5 (boss portions 21, 211, 212). The boss portions 24, 241 are formed so as to surround the boss portion 26 and protrude in the reverse direction to the boss portion 26. The boss portions 24, 241 are provided in a position corresponding to the boss portion 21 of the adjacent first core plate 5 in the z-axis direction. In the boss portions 24, 241, the oil passage hole 11 is adjacent to the through hole 13 provided at the boss portion 26. The boss portions 24, 241 are also disposed adjacent to the boss portion 25. The boss portions 24, 241 are formed in a concavo-convex shape in the cross-sectional direction of the second core plate 6. Moreover, in the boss portions 24, 241, the edge portion protruding from the second core plate 6, as seen in a plan view of the second core plates 6, 60, have one shape continuous with the edge portion of the boss portion 25.

As illustrated in FIG. 12, the basic aspect of the upper side second core plate 6U positioned at the uppermost portion of the heat exchange portion 2 is closely similar to that of the second core plates 6, 60. However, because of the relationship with the top plate 3, the upper side second core plate 6U has a configuration different to the other second core plates 6, 60 positioned at the intermediate portion of the heat exchange portion 2 as described below. Specifically, the boss portions 25, 26 are not provided in the upper side second core plate 6U at the uppermost portion. In other words, the boss portion 25 is not provided at the perimeter of the coolant passage hole 12 in the upper side second core plate 6U. Moreover, a boss portion 243 and boss portion 244 protruding towards the side of the coolant flow path between plates 8 (lower side) in the upper side second core plate 6U, are provided. The oil passage hole 11 and through hole 13 are not provided at the boss portion 243. The oil passage hole 11 and through hole 13 are provided at the boss portion 244.

The boss portions 243, 244 are protruded portions which are provided by protruding in the stacking direction from the upper side second core plate 6U; namely, any one direction of the z-axis direction, for example, the −z-axis direction (the lower side direction in the z-axis direction of the heat exchange portion 2). Of the boss portions 243, 244, the boss portion 244 is formed so as to protrude until abutting with the adjacent first core plate 5 (boss portion 21). The boss portion 244 surrounds the oil passage hole 11 and through hole 13, and the boss portion 26 is not formed around the through hole 13. The boss portions 243, 244 are provided in a position corresponding to the boss portion 21 of the adjacent first core plate 5 in the z-axis direction. In the boss portion 244, the oil passage hole 11 is adjacent to the through hole 13. The boss portions 243, 244 are disposed adjacent to the coolant passage hole 12. The boss portions 243, 244 are formed in a concavo-convex shape in the cross-sectional direction of the upper side second core plate 6U.

By alternatingly combining the first core plate 5 and second core plate 6 as above, fixed gaps which become the oil flow path between plates 7 and coolant flow path between plates 8 are formed between the first core plate 5 and second core plate 6.

The boss portions 21, 211, 212 provided at the perimeter of oil passage hole 11 and through hole 13 in the first core plate 5 and lower side first core plate 5L are joined to the boss portions 24, 241 provided at the perimeter of oil passage hole 11 and through hole 13 of the adjacent second core plate 6. Two oil flow paths between plates 7 adjacent in the up/down direction thereby communicate with each other, and are isolated from the coolant flow paths between plates 8 which is between the two oil flow paths between plates 7. Accordingly, in a state of a plurality of the first core plates 5 and a plurality of the second core plates 6 having been joined, the oil flow paths between plates 7 each communicate with each other via the plurality of oil passage holes 11.

The boss portion 25 provided at the perimeter of the coolant passage hole 12 in the second core plates 6, 60 is joined to the boss portion 22 provided at the perimeter of the coolant passage hole 12 of the adjacent first core plate 5. Two coolant flow paths between plates 8 adjacent in the up/down direction thereby communicate with each other, and are isolated from the oil flow paths between plates 7 which is between the two coolant flow paths between plates 8. Accordingly, in a state of a plurality of the first core plates 5 and a plurality of the second core plates 6 having been joined, the coolant flow paths between plates 8 each communicate with each other via a plurality of coolant passage holes 12.

The boss portion 23 around the through hole 13 in the first core plate 5 is joined to the boss portion 26 provided at the perimeter of through hole 13 of the second core plates 6, 60 adjacent in the up/down direction. As illustrated in FIG. 3, through holes 13 respectively communicate in an up/down direction.

Of the stacked plurality of plates in the heat exchange portion 2 of oil cooler 1, the oil passage hole 11 is not provided at the boss portion 241 of the second core plate 60 as in the aforementioned. Thus, the oil passage hole 11 is obstructed by the second core plate 60 in heat exchange portion 2. Because the oil passage hole 11 is thereby obstructed by the second core plate 60, an aspect of the flow path of oil in heat exchange portion 2 comprises a so-called multi-path (a plurality of paths) via the oil flow path between plates 7 formed in the up/down layer of the second core plate 60. Specifically, as illustrated in FIG. 3, because two second core plates 60 are provided, an aspect of the heat exchange portion 2 comprises three oil flow paths.

Of the stacked plurality of plates in the heat exchange portion 2, the through hole 13 and the boss portion 23 are not provided at the boss portion 211 of the lowermost layer of the lower side first core plate 5L as in the aforementioned. The boss portion 211 is joined to the boss portion 24 of the second core plate 6 directly above. Moreover, of the stacked plurality of plates in the heat exchange portion 2, the oil passage hole 11, through hole 13 and boss portion 26 are not provided at the boss portion 243 of the uppermost layer of the upper side second core plate 6U as in the aforementioned. The boss portion 243 is joined to the boss portion 21 of the first core plate 5 directly below. Thus, in a state of a plurality of the first core plates 5 and second core plates 6 having been joined, one of the pair of through holes 13 of the first core plate 5 and second core plates 6, 60 does not communicate with the oil flow path between plates 7 and the coolant flow path between plates 8.

Of the stacked plurality of plates in the heat exchange portion 2, although the through hole 13 is provided at the boss portion 212 of the lowermost layer of the lower side first core plate 5L as in the aforementioned, the oil passage hole 11 and boss portion 23 are not provided. The boss portion 212 is joined to the boss portion 24 of the second core plate 6 directly above. Moreover, of the stacked plurality of plates in the heat exchange portion 2, although the oil passage hole 11 and through hole 13 are provided at the boss portion 244 of the uppermost layer of the upper side second core plate 6U as in the aforementioned, the boss portion 26 is not provided. The boss portion 244 is formed so as to protrude until abutting with the boss portion 21 of the adjacent first core plate 5. The boss portion 244 is joined to the boss portion 21 of the first core plate 5 directly below. Thus, the through hole 13 of the boss portion 244 of the upper side second core plate 6U and the through hole 13 of the second core plates 6, 60 are connected in the stacking direction, the flowthrough path 130 isolated from the oil flow path between plates 7 and the coolant flow path between plates 8 is formed, and the flowthrough path 130 communicates with the oil passage hole 11 at the top portion via a circulating flow portion 29, which is an internal space formed between the boss portion 244 and top plate 3.

Top plate 3 comprises a coolant introduction portion 14 which communicates with one side of the coolant passage hole 12 of the uppermost portion of the heat exchange portion 2, and a coolant discharge portion 15 which communicates with the other side of the coolant passage hole 12 of the uppermost portion of the heat exchange portion 2. As illustrated in FIG. 1, FIG. 3 and FIG. 4, a coolant introduction pipe 16 is connected to the coolant introduction portion 14. As illustrated in FIG. 1, FIG. 3 and FIG. 4, a coolant discharge pipe 17 is connected to the coolant discharge portion 15. The oil cooler 1 supplies coolant from the coolant introduction pipe 16 to one side of the coolant passage hole 12, and discharges the coolant flowing through the other side of the coolant passage hole 12, from the coolant discharge pipe 17.

As illustrated in FIG. 3 and FIG. 8, the bottom plate 4 comprises an oil introduction portion 18 which communicates with one side of oil passage hole 11 of the lowermost part of the heat exchange portion 2, and an oil discharge portion 19 which communicates with the other side of oil passage hole 11 of the lowermost part of the heat exchange portion 2. Each of the oil introduction portion 18 and oil discharge portion 19 of the bottom plate 4 is affixed to a cylinder block (not shown) etc. via a sealing gasket (not shown) etc. The oil cooler 1 supplies oil from the oil introduction portion 18 to one side of the oil passage hole 11, and discharges the oil flowing through the other side of oil passage hole 11 and flowthrough path 130, from oil discharge portion 19.

As illustrated in FIG. 9 and FIG. 10, the first fin plate 9 has a substantially rectangular external shape, and comprises a pair of mutually facing longitudinal sides 9*a* and a pair of mutually facing lateral sides 9*b*.

The first fin plate 9 is joined, by a suitable method such as brazing, to flat portions in the second core plate 6 where boss portions 24, 25, 26 etc. are not provided. As illustrated in FIG. 11, the first fin plate 9 is formed by means of a fin plate main body 91 which is formed by a member with high thermal conductivity such as a sheet-like member made of aluminum. In the first fin plate 9, by bending the fin plate main body 91 by means of a suitable method such as bend working, fins are formed. In these fins, protruded portions 92 and recessed portions 93 are alternatingly provided towards the x-direction. Moreover, in the first fin plate 9, recessed portions 94 and protruded portions 95, which are formed by press working etc. at the side surfaces of the fins in the fin plate main body 91, are alternatingly formed towards the y-direction.

In a plan view, the first fin plate 9 has an anisotropy such that the flow path resistance in the direction parallel to the y-axis direction is less than the flow path resistance in the direction parallel to the x-axis direction. In other words, the first fin plate 9 has an anisotropy such that the flow path resistance in the direction parallel to the lateral side 9*b* is greater than the flow path resistance in the direction parallel to the longitudinal side 9*a*.

As illustrated in FIG. 5 and FIG. 7, the second fin plate 10 has a substantially rectangular external shape, and comprises a pair of mutually facing longitudinal sides 10*a* and a pair of mutually facing lateral sides 10*b*.

The second fin plate 10 is joined, by a suitable method such as brazing, to flat portions in the first core plate 5 where boss portions 21, 22, 23 etc. are not provided, and is positioned in the y-direction by a plurality of embossments 117 formed at the second core plate 6. As illustrated in FIG. 6, the second fin plate 10 is formed by means of a fin plate main body 101 which is formed by a member with high thermal conductivity such as a sheet-like member made of aluminum. In the second fin plate 10, by bending the fin plate main body 101 by means of a suitable method such as bend working, fins are formed. In these fins, protruded portions 102 and recessed portions 103 are alternatingly provided towards the x-direction. Moreover, in the second fin plate 10, recessed portions 104 and protruded portions 105 at the side surfaces of the fins in the fin plate main body 101, are alternatingly formed towards the y-direction.

In a plan view, the second fin plate 10 has an anisotropy such that the flow path resistance in the direction parallel to the y-axis direction is less than the flow path resistance in the direction parallel to the x-axis direction. In other words, the second fin plate 10 has an anisotropy such that the flow path resistance in the direction parallel to the lateral side 10*b* is greater than the flow path resistance in the direction parallel to the longitudinal side 10*a*.

As illustrated in FIG. 5 and FIG. 7, in the first core plate 5 and the lower side first core plate 5L, the edge portion 27 is provided at the boss portions 21, 211, 212. The edge portion 27 functions as a second edge portion in contact with the coolant configured as a second fluid. The edge portion 27 is provided at the part of the boss portion 21 facing towards the central side of the first core plate 5 and lower side first core plate 5L; in other words, at the part facing the second fin plate 10. As illustrated in FIG. 5 and FIG. 7, the edge portion 27 is formed so as to extend in the x-axis direction (left-right direction). The edge portion 27 is formed such that a gap with the second fin plate 10 is narrowed in the second direction towards the end portion of the first core plate 5 and lower side first core plate 5L in the left-right direction. As seen in a plan view here, the edge portion 27 is provided so as to have an angle (have a slant) with respect to a standing wall portion 116 which corresponds to a side of the first core plate 5 which is formed in a substantially rectangular shape.

Because the edge portion 27 comprises the above shape, the flow of coolant from one side of the coolant passage hole 12 towards the other side of the coolant passage hole 12 on the first core plate 5 and lower side first core plate 5L in the heat exchange portion 2, seeps into the second fin plate 10 whilst spreading towards the second direction of the coolant flow path between plates 8 following along edge portion 27. The coolant having seeped into the second fin plate 10 in the first core plate 5 and lower side first core plate 5L flows towards the other side of the coolant passage hole 12 provided in the y-direction following along the fins. In other words, according to the oil cooler 1, because the first core plate 5 and lower side first core plate 5L comprise the edge portion 27, coolant can be made to spread onto the entire surface of the second fin plate 10.

As illustrated in FIG. 9 and FIG. 10, at second core plates 6, 60, an edge portion 28 is provided at the boss portion 25. The edge portion 28 functions as a first edge portion in contact with the oil configured as a first fluid. The edge portion 28 is provided at the part of the boss portion 25 facing towards the central side of the second core plates 6, 60; in other words, at the part facing the first fin plate 9. As illustrated in FIG. 8 and FIG. 10, edge portion 28 is formed so as to extend in the x-axis direction (left-right direction). The edge portion 28 is formed such that a gap with the first fin plate 9 is narrowed in the second direction towards the end portion of the plate in the left-right direction. As seen in a plan view here, the edge portion 28 is provided so as to have an angle (have a slant) with respect to a standing wall portion 126 which corresponds to a side of the second core plates 6, 60 which are formed in a substantially rectangular shape.

Because the edge portion 28 comprises the above shape, the flow of oil flowing through the oil flow path between plates 7, from one side of oil passage hole 11 towards the other side of oil passage hole 11 on the second core plate 6 in the heat exchange portion 2, seeps into the first fin plate 9 whilst spreading towards the x-direction of the oil flow path between plates 7 following along the edge portion 28. The oil having seeped into the first fin plate 9 in the second core plates 6, 60 flows towards the other side of oil passage hole 11 provided in the y-direction following along the fins. In other words, according to the oil cooler 1, because the second core plates 6, 60 comprise the edge portion 28, oil can be made to spread onto the entire surface of the first fin plate 9.

Moreover, coolant introduced from the coolant introduction portion 14 of top plate 3 flows through a coolant flow path between plates 8, flows inside the heat exchange portion 2 on the whole in a direction orthogonal to the stacking direction of the first core plate 5 and second core plate 6, and reaches the coolant discharge portion 15 of top plate 3. The 'Water In' solid line arrow mark in FIG. 3 illustrates the flow of coolant at the introduction side. The 'Water Out' dashed line arrow mark in FIG. 3 illustrates the flow of coolant at the discharge side. The oil introduced from the oil introduction portion 18 of the bottom plate 4 flows through the oil flow path between plates 7, flows inside the heat exchange portion 2 on the whole in a direction orthogonal to the stacking direction of the first core plate 5 and second core plate 6, and reaches the oil discharge portion 19 of the bottom plate 4. The 'Oil In' single-dot dashed line arrow mark in FIG. 3 illustrates the flow of oil at the introduction side. The 'Oil Out' double-dot dashed line arrow mark in FIG. 3 illustrates the flow of oil at the discharge side.

In the oil cooler 1 comprising a heat exchange portion 2 configured by the plurality of plates as above, an oil pathway is formed as follows. Oil introduced into the heat exchange portion 2 from the oil introduction portion 18 goes towards the uppermost layer of the upper side second core plate 6U whilst passing through the oil passage hole 11 and oil flow path between plates 7. The oil flows towards the uppermost layer of the upper side second core plate 6U whilst the oil flow changes direction from the lower layer of the second core plate 60 where the oil passage hole 11 is obstructed, and the oil flow changes direction between the upper layer of the oil flow path between plates 7.

Oil passing through the oil flow path between plates 7 at the uppermost layer goes through the oil passage hole 11 of the uppermost layer of the first core plate 5, reaches the upper side second core plate 6U, flows in at the circulating flow portion 29 formed between the boss portion 244 of the upper side second core plate 6U and the lower face of top plate 3, goes through a through hole 13 formed at the boss portion 244 of the upper side second core plate 6U, flows in at the flowthrough path 130, and goes through the flow-through path 130 until reaching the lowermost layer of the lower side first core plate 5L, where the oil is discharged from the oil discharge portion 19 via the inner side of the boss portion 212.

As explained above, in the oil cooler 1, boss portions 21, 211, 212, 24, 241, 243, 244 are formed in the first core plate 5, lower side first core plate 5L, second core plates 6, 60, and upper side second core plate 6U, at a position surrounding two holes (oil passage hole 11 and through hole 13), where these boss portions have the same outer side contour shape as the oil passage hole 11 and through hole 13. Hence, there is no need to form a dome-shaped pathway at the upper portion of top plate 3 of the heat exchange portion 2, or to provide the oil flow path between plates 7 by further adding a lower layer plate of the lowermost layer of the lower side first core plate 5L, in order to be able to provide the pathways of the uppermost layer and lowermost layer for circulating oil and coolant introduced in the heat exchange portion 2 in the stacked plates. Thus, according to the oil cooler 1, height can be reduced in the stacking direction (up-down direction) of the plates.

Although the embodiment of the present invention is explained as above, the present invention is not limited to the heat exchanger according to the aforementioned embodiment of the present invention, and includes any mode encompassed in the concept and claims of the present invention. Moreover, the constituents may be suitably and selectively combined so as to exhibit at least a portion of the aforementioned object and effect. For example, shapes, materials, arrangements and sizes etc. of the constituents in the aforementioned embodiment may be suitably changed depending on the specific mode of use of the present invention.

Although a recirculation portion is provided at the uppermost portion of the oil flow path in the aforementioned example, this can also be provided at the lowermost part, or provided at the coolant flow path.

The invention claimed is:

1. A heat exchanger, comprising:

a heat exchange core including a stacked plurality of plates, a top plate and a bottom plate, the stacked plurality of plates comprises two end portion plates, and a plurality of intermediate plates stacked between the two end portion plates, the two end portion plates including an upper side end portion plate and a lower side end portion plate relative to a stacking direction, of the stacked plurality of plates, each set of adjacent said plates demarcates a flow path between plates such that fluid flows therebetween, each of the stacked plurality of plates has a flow-through portion penetrating through the respective plates through which a fluid flows, and at least one set of the flow-through portion is provided at one of the flow paths between plates, so as to enable the fluid to flow from one side to an other side, each of the stacked plurality of plates further comprises a through hole, and each of the through holes demarcates a portion of a flowthrough path which penetrates through the stacked plurality of plates in the stacking direction and is isolated from the flow path between plates, a boss portion comprising a substantially elliptically shaped edge portion is formed at each of the plates of the stacked plurality of plates, the substantially elliptically shaped edge portion structured and arranged to extend along and surround an outer side of both of the flow-through portion and the through hole, as seen in a plan view of the heat exchange core, and of the two end portion plates, a circulating flow portion is formed as an internal space of the boss portion, in at least either one of the upper side end portion plate and the lower side end portion plate.

2. The heat exchanger according to claim 1, wherein the plurality of intermediate plates include:

a first core plate of which the boss portion protrudes at an upper side of the stacking direction; and a second core plate of which the boss portion protrudes at a lower side of the stacking direction.

3. The heat exchanger according to claim 1, wherein:

the upper side end portion plate includes an upper side second core plate, in the upper side second core plate:

the boss portion is provided by protruding to a lower side and the top plate is brazed to an upper face, and the circulating flow portion is defined in between the flow-through portion, the through hole, the boss portion, and the top plate.

4. The heat exchanger according to claim 1, wherein:

the lower side end portion plate includes a lower side first core plate, in the lower side first core plate, a further boss portion is provided that protrudes to an upper side, the through hole is not provided at the further boss portion, and the bottom plate is brazed to a lower face, and in the bottom plate, a hole is disposed at the position of the flow-through portion as seen in a plan view of the heat exchange core, the hole defining a portion of the flow-through portion.

5. The heat exchanger according to claim 4, wherein:

the further boss portion of the lower side end portion plate has an oil passage hole.

6. The heat exchanger according to claim 3, wherein:

the upper side end portion plate has a further boss portion without the through hole and the flow-through portion.

7. The heat exchanger according to claim 1, wherein the plurality of intermediate plates further include a second boss portion having a coolant passage that defines a second flow-through portion.

8. The heat exchanger according to claim 1, wherein the flow-through portion in the boss portion is defined by an oil hole, such that the edge portion surrounds both of the oil hole and the through hole.

9. The heat exchanger according to claim 1, wherein the plurality of intermediate plates comprise a first core plate including a fin plate.

10. The heat exchanger according to claim 1, wherein the edge portion has a region extending at a slant with respect to a standing wall portion of the corresponding stacked plate.

11. A heat exchange core of a heat exchanger, comprising:

a stacked plurality of plates, a top plate, and a bottom plate;

the stacked plurality of plates comprising two end portion plates, and a plurality of intermediate plates stacked between the two end portion plates, the two end portion plates including an upper side end portion plate and a lower side end portion plate relative to a stacking direction;

wherein each set of adjacent plates of the stacked plurality of plates defines a flow path between plates such that fluid flows therebetween;

each of the stacked plurality of plates has a flow-through portion penetrating through the respective plates through which a fluid flows, and at least one set of the flow-through portion is provided at one of the flow paths between plates, so as to enable the fluid to flow from one side to an other side;

each of the stacked plurality of plates further comprises a through hole, and each of the through holes demarcates a portion of a flowthrough path which penetrates through the stacked plurality of plates in the stacking direction and is isolated from the flow path between plates;

a boss portion comprising a substantially elliptically shaped edge portion is formed at each of the plates of the stacked plurality of plates, the edge portion structured and arranged to extend along and surround an outer side of both of the flow-through portion and the through hole, as seen in a plan view of the heat exchange core; and of the two end portion plates, a circulating flow portion is formed as an internal space of the boss portion, in at least either one of the upper side end portion plate and the lower side end portion plate.

12. The heat exchange core according to claim 11, wherein the plurality of intermediate plates include:

a first core plate of which the boss portion protrudes at an upper side of the stacking direction; and a second core plate of which the boss portion protrudes at a lower side of the stacking direction.

13. The heat exchange core according to claim 11, wherein:

the upper side end portion plate includes an upper side second core plate, in the upper side second core plate:

the boss portion is provided by protruding to a lower side and the top plate is brazed to an upper face, and the circulating flow portion is defined in between the flow-through portion, the through hole, the boss portion, and the top plate.

14. The heat exchange core according to claim 11, wherein:

the lower side end portion plate includes a lower side first core plate, in the lower side first core plate, a further boss portion is provided that protrudes to an upper side, the through hole is not provided at the further boss portion, and the bottom plate is brazed to a lower face, in the bottom plate, a hole is disposed at the position of the flow-through portion as seen in a plan view of the heat exchange core, the hole defining a portion of the flow-through portion.

15. The heat exchange core according to claim 14, wherein the further boss portion of the lower side end portion plate has an oil passage hole.

16. The heat exchange core according to claim 13, wherein the upper side end portion plate has a further boss portion without the through hole and the flow-through portion.

17. The heat exchange core according to claim 9, wherein the flow-through portion in the boss portion is defined by an oil hole, such that the edge portion surrounds both of the oil hole and the through hole.

18. The heat exchange core according to claim 17, wherein the plurality of intermediate plates include a second boss portion having a coolant passage that defines a second flow-through portion.

* * * * *